US008022890B2

(12) United States Patent
Bondyopadhyay

(10) Patent No.: US 8,022,890 B2
(45) Date of Patent: Sep. 20, 2011

(54) MINIATURIZED QUADRIFILAR HELIX ANTENNA

(75) Inventor: Probir K. Bondyopadhyay, Houston, TX (US)

(73) Assignee: Mobile Satellite Ventures, LP, Reston, VA (US)

( * ) Notice: Subject to any disclaimer, the term of this patent is extended or adjusted under 35 U.S.C. 154(b) by 996 days.

(21) Appl. No.: 11/777,031

(22) Filed: Jul. 12, 2007

(65) Prior Publication Data

US 2008/0014927 A1 Jan. 17, 2008

Related U.S. Application Data

(60) Provisional application No. 60/807,110, filed on Jul. 12, 2006, provisional application No. 60/807,112, filed on Jul. 12, 2006, provisional application No. 60/807,107, filed on Jul. 12, 2006.

(51) Int. Cl.
*H01Q 1/36* (2006.01)

(52) U.S. Cl. ..... 343/895

(58) Field of Classification Search ..... None
See application file for complete search history.

(56) References Cited

U.S. PATENT DOCUMENTS

| | | | | |
|---|---|---|---|---|
| 4,148,030 | A | 4/1979 | Foldes | |
| 5,986,620 | A * | 11/1999 | Filipovic | 343/895 |
| 5,990,847 | A * | 11/1999 | Filipovic et al. | 343/895 |
| 6,407,720 | B1 | 6/2002 | Josypenko | |
| 6,587,081 | B2 * | 7/2003 | Noro et al. | 343/895 |
| 6,836,257 | B2 * | 12/2004 | Louvigne et al. | 343/895 |
| 7,142,170 | B2 * | 11/2006 | Saunders et al. | 343/895 |

FOREIGN PATENT DOCUMENTS

| | | |
|---|---|---|
| WO | WO 99/60665 | 11/1999 |
| WO | WO 02/23673 | 3/2002 |

OTHER PUBLICATIONS

International Search Report and Written Opinion for corresponding PCT Application No. PCT/US2007/073382 mailed Nov. 7, 2007, 10 pages.

* cited by examiner

*Primary Examiner* — Trinh V Dinh
(74) *Attorney, Agent, or Firm* — Snyder, Clark, Lesch & Chung, LLP

(57) ABSTRACT

A quadrifilar helix antenna used to transmit and receive wireless signals may include a number of inductively loaded antenna elements. The antenna elements may be helically wound around a cylindrical structure.

11 Claims, 12 Drawing Sheets

MINIATURIZED QUADRIFILAR HELIX ANTENNA

RELATED APPLICATIONS

This application claims priority under 35 U.S.C. §119 based on U.S. Provisional Application No. 60/807,110 filed Jul. 12, 2006, U.S. Provisional Application Ser. No. 60/807,112 filed Jul. 12, 2006, and U.S. Provisional Application Ser. No. 60/807,107 filed Jul. 12, 2006, the disclosures of which are all hereby incorporated herein by reference.

FIELD OF THE INVENTION

This invention relates in general to miniaturization of resonant antennas and, more particularly, to miniaturization of resonant antennas for hand-held terminals used for mobile wireless communications.

BACKGROUND

In wireless communications involving artificial satellites, a circular polarized antenna with near omni-directional coverage is generally required such that the link is not interrupted by mobility at either end of the communications link. For simultaneous two-way communications, two separate communication channels or frequency bands are used. The electromagnetic frequency spectrum used for this purpose generally falls within the range of 700 megahertz (MHz) through 7500 MHz. In one such application for commercial purposes, the transmit band for terrestrial terminals is 1626.5 MHz through 1660.5 MHz and the receive band is 1525 MHz through 1559 MHz.

A quadrifilar helix antenna (QHA) is capable of performing these communication functions for hand-held terminals. In order for optimum power transfer to take place through the antenna, such antennas operate at resonance for both the channels (i.e., receive and transmit).

The QHA typically includes an array of monopoles twisted into a helical structure and connected by a non-radiating feed structure to excite the desired sense of circular polarization of the desired sense (right handed or left handed). The antenna is constricted with less than a full turn such that the radiation pattern of the antenna becomes substantially omni-directional without any null occurring in the communication space. This condition is generally known as the normal mode of operation of the helical antenna. The antenna elements are generally constructed as printed conducting strips on a thin dielectric substrate. The frequency bands for communication determines the resonant length of the antenna elements and hence the antenna height, whereas the radiation pattern or antenna gain requirements determine the diameter to height ratio in terms of the operating central frequency of the band.

Convenience and ease of operation creates the need to miniaturize the antenna such that the individual consumer can easily carry the hand-held terminal. Wireless signals transmitted directly from a satellite may not be strong enough to penetrate walls to reach a person inside a building or operating in a city area with high rise building. However, a hybrid system generally known in the industry as Mobile Satellite Services (MSS) with Ancillary Terrestrial Components (ATC) overcomes this shortcoming by using satellites integrally with terrestrial cellular wireless communication networks. This advancement in mobile wireless communication technology has created a consumer demand to have hand-held satellite-cellular terminals that are thinner and smaller.

For the frequency bands of mobile wireless communications in the frequency range of 1000 MHz through 3000 MHz, the regular QHAs for the transmit and the receive bands are about the size of a cigar. For example, the QHA may have a length of approximately six to seven inches and diameter of about 0.75 inches.

SUMMARY

Aspects described herein provide a QHA having a very small size. For example, aspects described herein provide a QHA that is approximately 2.75 inches to 3 inches in length or less and approximately 0.3 to 0.35 inch in diameter or less. This enables the hand-held terminal in which the QHA is implemented to have a reduced size.

BRIEF DESCRIPTION OF THE DRAWINGS

Reference is made to the attached drawings, wherein elements having the same identifier/name may represent like elements throughout.

DETAILED DESCRIPTION

The following detailed description of the invention refers to the accompanying drawings. The same reference numbers in different drawings may identify the same or similar elements. Also, the following detailed description does not limit the invention. Instead, the scope of the invention is defined by the appended claims and equivalents.

Exemplary Network

Figure 1:
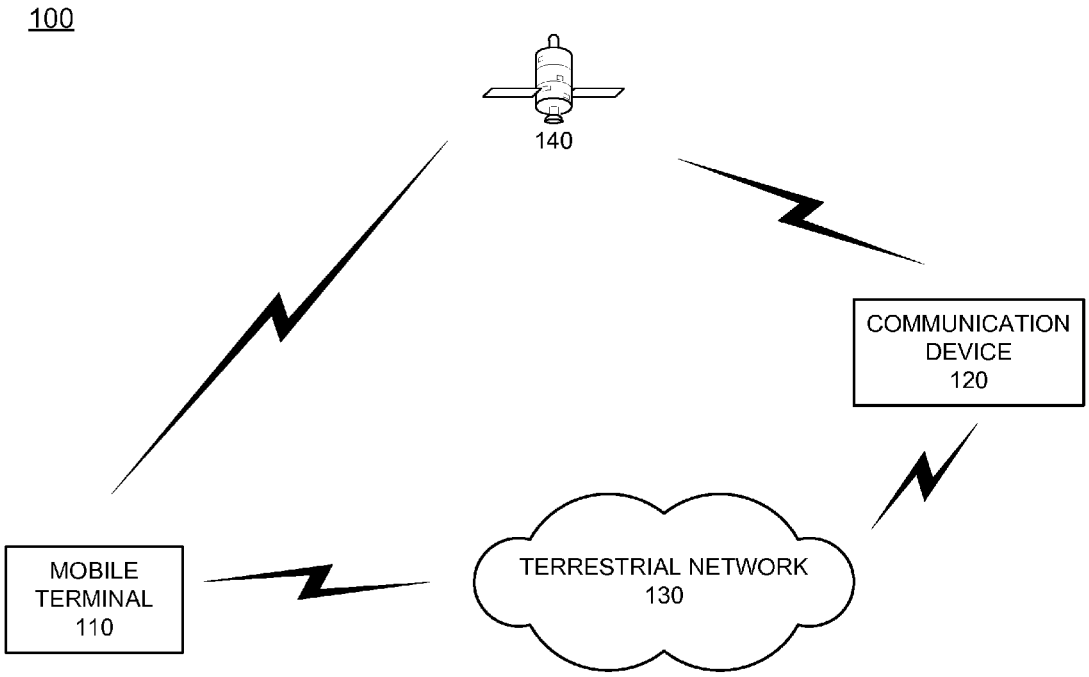
FIG. 1 illustrates an exemplary network in which devices, systems and methods described herein may be implemented.

FIG. 1 is a diagram of an exemplary network 100 in which devices, systems and methods described herein may be implemented. Referring to FIG. 1, network 100 may include mobile terminal 110 (also referred to as a hand-held terminal), communication device 120, terrestrial network 130 and satellite 140. The number of devices shown in network 100 is provided for simplicity. It should be understood that network 100 may include additional devices that aid in the transmission and reception of information, as well as additional mobile terminals and communication devices.

Mobile terminal 110 may include components for transmitting and receiving radio frequency (RF) signals via terrestrial network 130 and satellite 140. In an exemplary implementation, mobile terminal 110 may include a cellular radiotelephone, a Personal Communications System (PCS) terminal that may combine a cellular radiotelephone with other data processing/communications capabilities; a personal digital assistant (PDA), a conventional laptop and/or palmtop receiver or other appliance that includes a radiotelephone transceiver. In an exemplary implementation, mobile terminal 110 may be configured to communicate with other devices/systems, such as communication device 120, via terrestrial network 130 and/or via satellite 140. In an exemplary implementation, mobile terminal 110 may communicate with terrestrial network 130 using, for example, the L-band, the S-band, or another RF band.

Communication device 120 may include any type of device that is capable of transmitting and receiving voice signals and/or data signals to/from a network. For example, communication device 120 may include any conventional telephone that interfaces with, for example, the public switched telephone network (PSTN) or a wireless network to place and receive telephone calls. Communication device 120 may be a standard PSTN-based telephone, a cordless telephone, a cellular telephone, a PDA, a mobile device similar to mobile terminal 110 or another type of conventional telephone.

Communication device 120 may also include any client, such as a computer device, web-based appliance, etc., that is configured to provide telephone functions. For example, communication device 120 may be a session initiation protocol (SIP)-based telephone.

Terrestrial network 130 may include one or more wired and/or wireless networks that are capable of receiving and transmitting data and voice signals. For example, terrestrial network 130 may include one or more PSTNs or other type of switched network. Terrestrial network 130 may also include packet switched networks, such as the Internet, an intranet, a wide area network (WAN), a metropolitan area network (MAN) or another type of network capable of transmitting data from a source device to a destination device.

Terrestrial network 130 may also include one or more earth-based cellular networks that include components for transmitting and receiving data and voice signals using RF communications. Such components may include base station antennas and transmission towers (not shown) that transmit and receive data from mobile terminals within their vicinity. Such components may also include base stations (not shown) that connect to the base station antennas and communicate with other devices, such as switches and routers (not shown) in accordance with known techniques.

Satellite 140 may represent one or more space-based components that are included in a satellite-based network. Satellite 140 may communicate with mobile terminal 110 and other devices in system 100, such as various gateways, routers, etc., that interface with other networks, such as terrestrial network 130. Satellite 140 may communicate with mobile terminal 110 using, for example, the L-band, the S-band, or another RF band.

Figure 2:
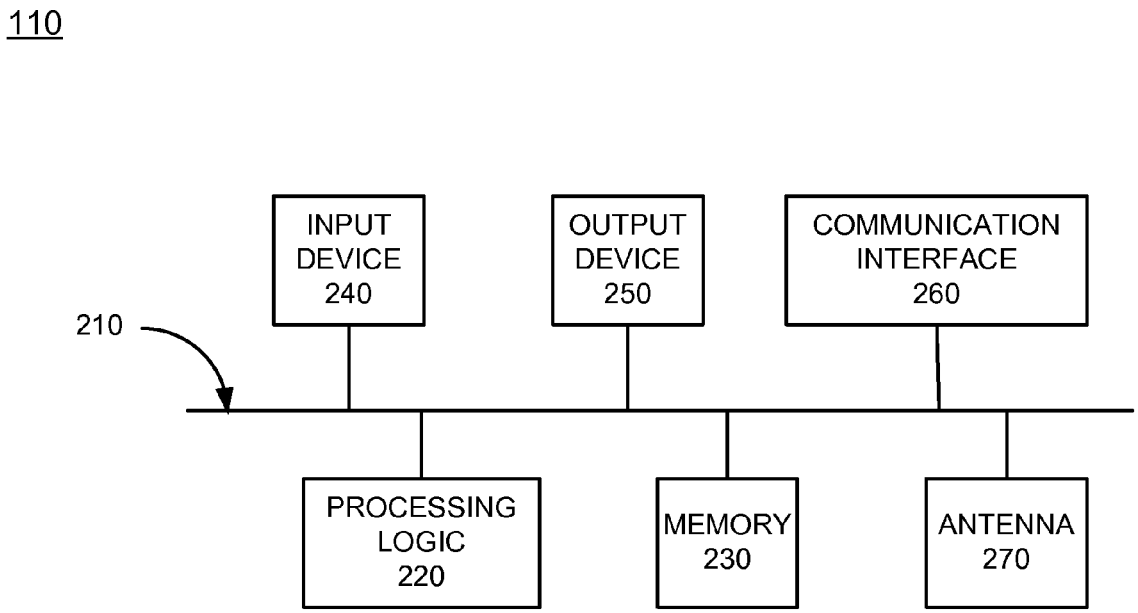
FIG. 2 is an exemplary block diagram of the mobile terminal of FIG. 1.

FIG. 2 is a block diagram illustrating an exemplary configuration of mobile terminal 110. Mobile terminal 110 may include bus 210, processing logic 220, memory 230, input device 240, output device 250, communication interface 260 and antenna 270. Bus 210 permits communication among the components of mobile terminal 110. One skilled in the art would recognize that mobile terminal 110 may be configured in a number of other ways and may include other or different elements. For example, mobile terminal 110 may include one or more power supplies (not shown). Mobile terminal 110 may also include a modulator, a demodulator, an encoder, a decoder, etc., for processing data.

Processing logic 220 may include a processor, microprocessor, an application specific integrated circuit (ASIC), field programmable gate array (FPGA) or the like. Processing logic 220 may, in some implementations, execute software instructions/programs or data structures to control operation of mobile terminal 110.

Memory 230 may include a random access memory (RAM) or another type of dynamic storage device that stores information and instructions for execution by processing logic 220; a read only memory (ROM) or another type of static storage device that stores static information and instructions for use by processing logic 220; a flash memory (e.g., an electrically erasable programmable read only memory (EEPROM)) device for storing information and instructions; and/or some other type of magnetic or optical recording medium and its corresponding drive. Memory 230 may also be used to store temporary variables or other intermediate information during execution of instructions by processing logic 220. Instructions used by processing logic 220 may also, or alternatively, be stored in another type of computer-readable medium accessible by processing logic 220.

Input device 240 may include one or more mechanisms that permits an operator to input information to mobile terminal 110. For example, input device may include a microphone, a keyboard, a keypad, a mouse, a pen, voice recognition and/or biometric mechanisms, etc. Input device 240 may be used to facilitate placing telephone calls to other devices, carrying on a conversation, etc.

Output device 250 may include one or more mechanisms that output information to the user, including a display, one or more speakers, a printer, etc. Output device 250 may be used to facilitate receiving telephone calls from other devices, carrying on a conversation, etc.

Communication interface 260 may include any transceiver-like mechanism that enables mobile terminal 110 to communicate with other devices and/or systems. For example, communication interface 260 may include mechanisms for communicating via a network, such as a wireless network. For example, communication interface 260 may include one or more radio frequency (RF) transmitters and receivers and/or transceivers, used to transmit and receive RF signals via antenna 270.

Antenna 270 may include one or more antennas, transmitters and receivers that enable mobile terminal 110 to communicate with terrestrial network 130 using, for example, L band, S band or another RF band. In an exemplary implementation, antenna 270 may include one or more QHAs, as described in detail below.

The size of the antenna, such as a QHA 270, may be represented by the length and diameter of a cylindrical frame on which antenna elements reside and may be dictated by the frequency bands of the transmit and receive signals and the requirements of near omni-directional coverage. Wireless communications with mobile terminal 110 take place when QHA 270 is in resonance. During communications, wireless signals being processed through QHA 270 experience an impedance which has a real component and an imaginary component. The imaginary component of the impedance (i.e., reactance) at a particular frequency component of the communicating signal is either positive (inductive) or negative (capacitive). QHA 270 is said to be in resonance when this imaginary part of the impedance is zero at the center frequency of the signal band.

The resonance condition of QHA 270 depends on various structural parameters of the antenna elements and various physical parameters that define the surrounding electrical environment. The resonant frequency of each antenna element and hence, QHA 270 itself, can be lowered by increasing the reactive component of the antenna element impedance. Aspects described herein provide for optimal modification of each of the antenna elements to increase its reactance within the available real estate for the antenna element, so as to reduce the size of the antenna by lowering the resonant frequency.

Figure 3:
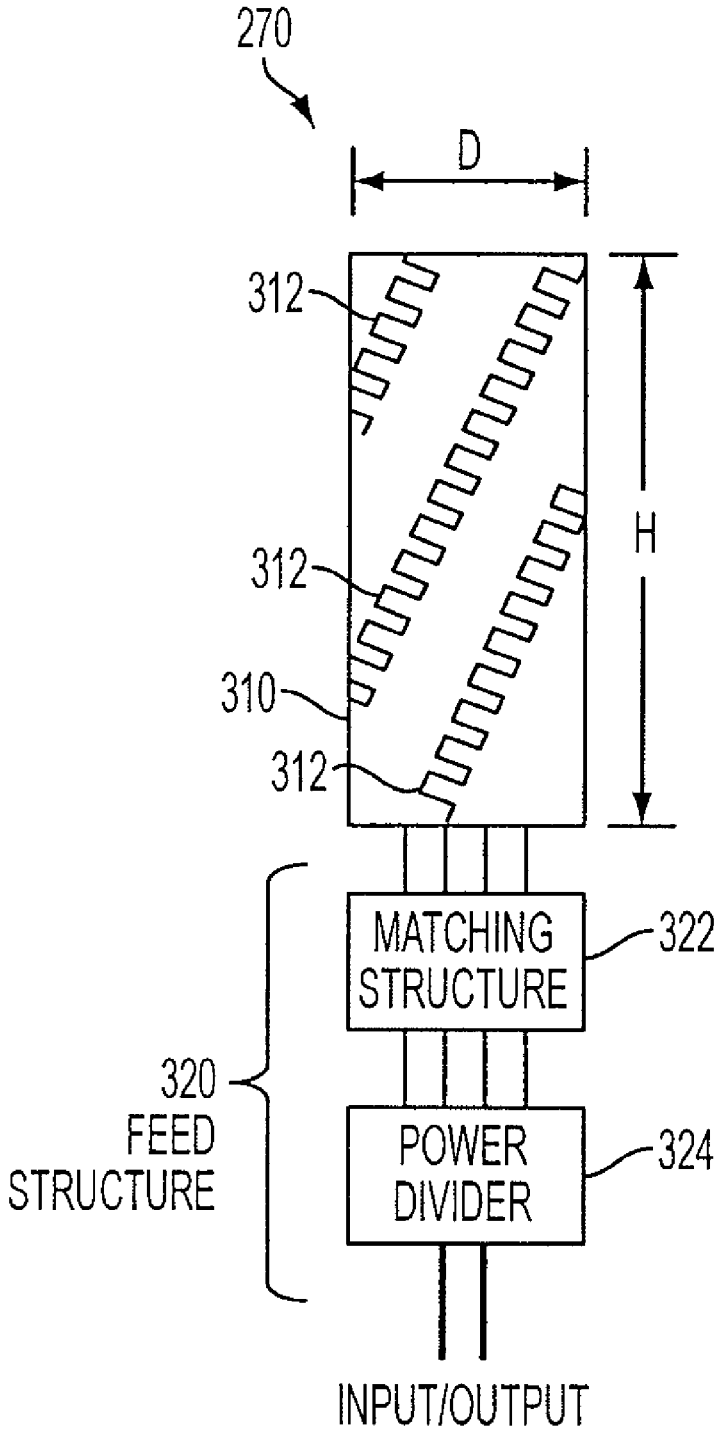
FIG. 3 illustrates a schematic diagram of an exemplary QHA.

FIG. 3 is a schematic diagram of antenna 270 according to an exemplary implementation. In this implementation, antenna 270 is a QHA that includes cylindrical structure 310 having a height H and diameter D. In accordance with one implementation, H may be approximately 2.75 inches and D may be approximately 0.35 inches. Other heights and diameters may be possible in other implementations. For example, H may range from about 2.75 inches to about 3 inches, or less, and D may range from about 0.3 inches to 0.35 inches or less. Cylindrical structure 310 may be coupled to feed structure 320.

As illustrated in FIG. 3, structure 310 includes multiple conductive strips 312 (e.g., four conductive strips 312 that form a four element array) of conducting monopoles helically wound around cylindrical structure 312 in the longitudinal direction. In the implementation illustrated in FIG. 3, each of the conductive strips 312 has a square wave-like pattern.

The four conductive strips 312 (i.e., antenna elements) may each be connected to feed structure 320 to provide circular polarization capability of the desired sense to the wireless signals processed by antenna 270 for transmission and reception. Feed structure 320 may include an impedance matching structure 322 and a power divider 324 to allow for maximum power transfer within the operating bands. However, in an exemplary implementation, feed structure 320 and the antenna elements may be designed to be impedance matched to each other without the need for a separate impedance matching structure 322.

Each of the conductive strips 312 (i.e., antenna elements), and antenna 270 as a whole, is a resonant device with multiple resonances determined by the electrical lengths of the antenna elements. Each of the discrete resonances can be expressed by an equivalent inductance $L_{eq}$ and a capacitance $C_{eq}$ in the following known expression.

$$f_{reso} = \frac{1}{2\pi\sqrt{L_{eq}C_{eq}}}$$

where $f_{reso}$ is a resonant frequency. If the transmit and receive frequency bands are located close enough to each other, a single resonance can perform both the transmit and receive functions by accommodating the two bands and providing necessary isolation between the separate transmit and receive signals outside of antenna 270. Otherwise, two separate resonant antennas may be used to provide the transmit and the receive functions.

The electrical length L of antenna element 312 that corresponds to a resonance can be reduced by: 1) increasing the equivalent inductance $L_{eq}$; 2) increasing the equivalent capacitance $C_{eq}$; or 3) reducing both the equivalent inductance $L_{eq}$ and the equivalent capacitance $C_{eq}$. In this manner, the size of antenna elements 312 (e.g., the length of conductive strips 312) in the QHA may be reduced, thereby reducing the overall size of the QHA.

Figure 4:
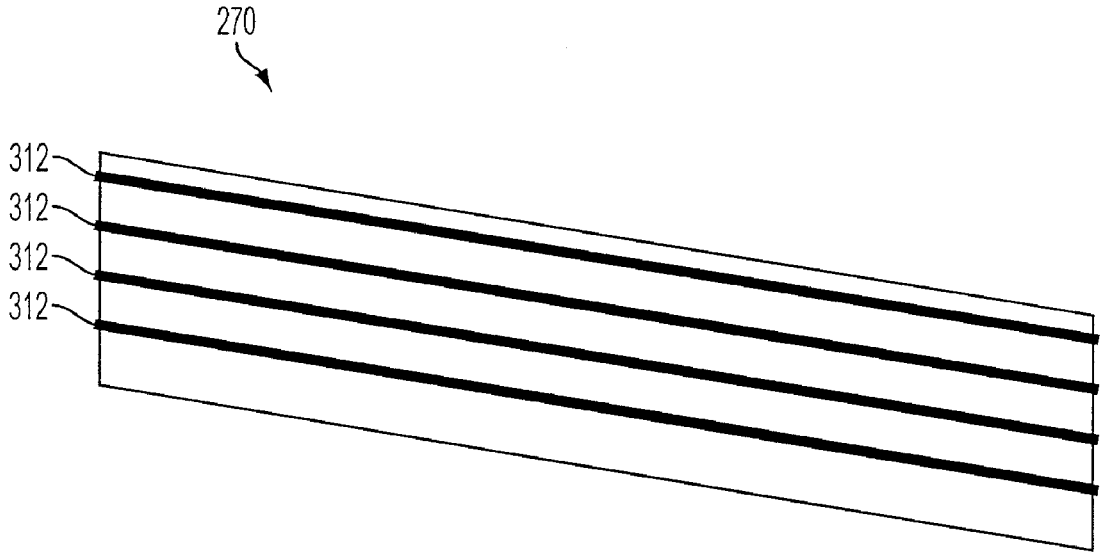
FIG. 4 is an exemplary diagram of unfurled printed conducting strip antenna elements of a QHA.

FIG. 4 illustrates the unfurled surface area of the QHA with a cylindrical helical structure containing four printed antenna elements 312. Each antenna element 312 is illustrated as a linear conducting strip 312. It should be understood that more or fewer conducting strips 312 may be used in other implementations and the size and/or shape of the conducting strips may be different in other implementations.

Figure 5:
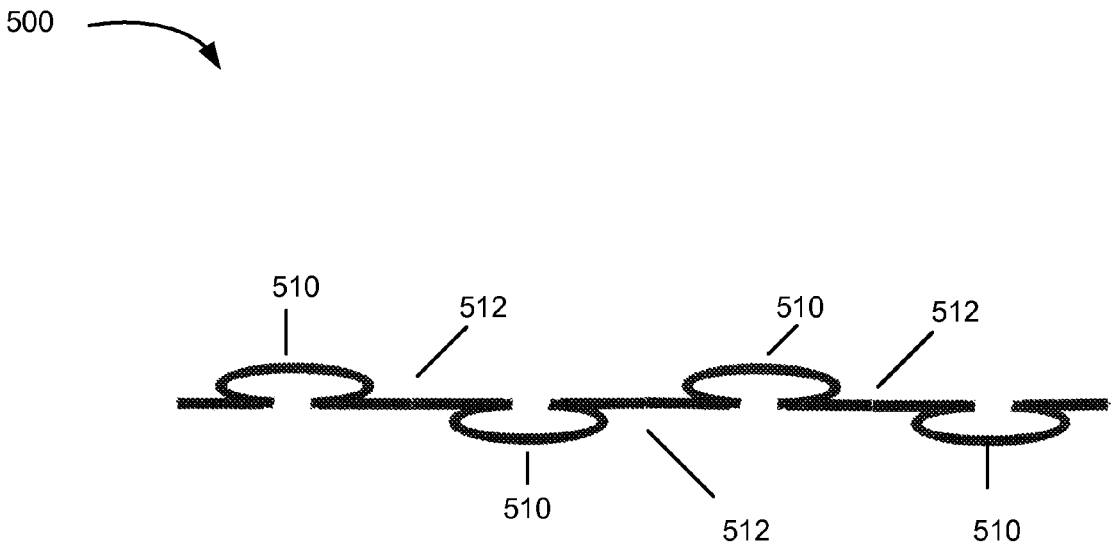
FIG. 5 is an exemplary diagram of an unfurled printed conducting strip antenna element.

FIG. 5 illustrates a printed antenna element 500 with distributive inductive loading that may be used for antenna 270. Referring to FIG. 5, antenna element 500 may include alternately opposing or inverted omega shaped portions 510 connected to each other via straight line portions 512. In this implementation, a number of the antenna elements (e.g., four antenna elements 500) may be wound on cylindrical structure 310 with a constant pitch angle. That is, the angle connecting elements 510 and 512 is constant throughout each of the antenna elements 500, as illustrated in FIG. 5.

Figure 6:
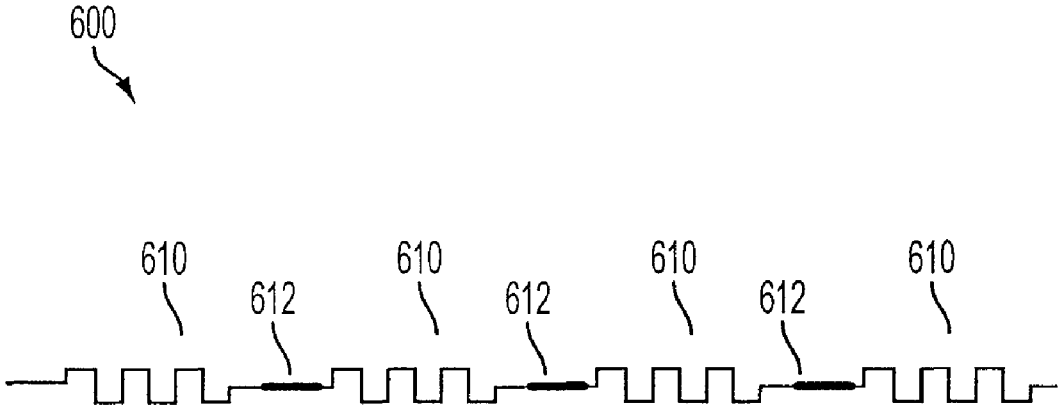
FIG. 6 illustrates an exemplary inductively loaded printed conducting strip antenna element.

FIG. 6 illustrates another implementation of a printed antenna element that may be used for antenna 270. Referring to FIG. 6, antenna element 600 includes groupings of square wave-like portions 610 connected to each other by straight line portions 612. In this implementation, a number of the antenna elements (e.g., four antenna elements 600) may be wound on cylindrical structure 310 with a constant pitch angle. In this manner, the QHA 270 may have distributed inductive loading to allow for the QHA to have a reduced height with respect to conventional QHAs.

Figure 7:
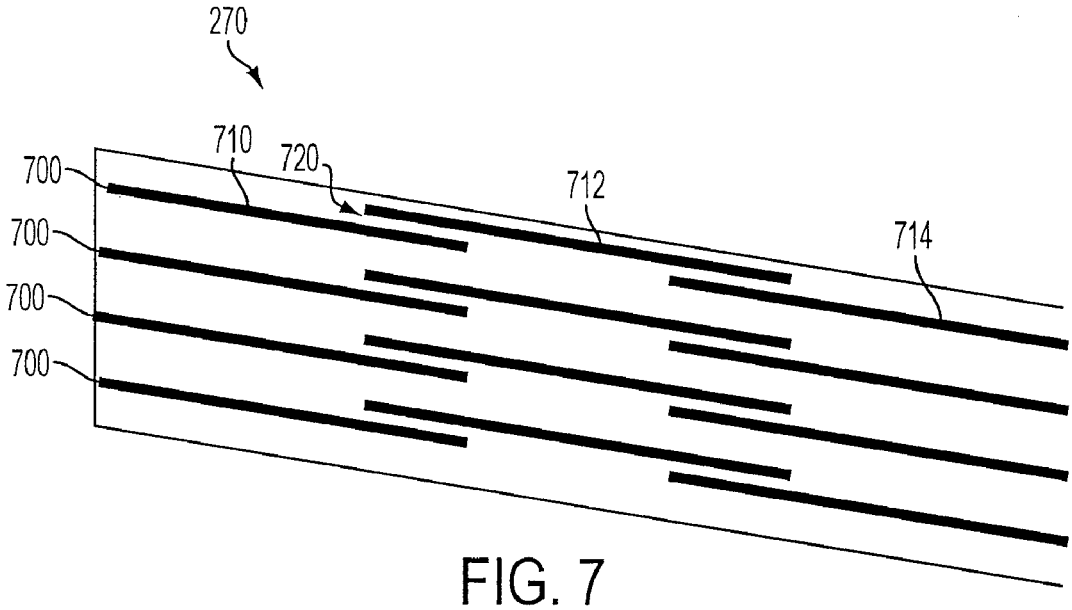
FIG. 7 illustrates an exemplary capacitively loaded printed conducting strip antenna element.

FIG. 7 illustrates another implementation of antenna 270. Referring to FIG. 7, antenna 270 includes a number (e.g., four) antenna elements 700 having distributed capacitive loading, thereby enabling the cylindrical structure 310 of antenna 270 to have a reduced height as compared to conventional QHAs. As illustrated, each antenna element 700 has segments 710, 712 and 714. The gap, illustrated at reference numeral 720 in FIG. 7, between each of the adjacent segments may be designed to be less than the width of each of the segments. For example, gap 720 separating element 710 and 712 may be set to be less than the width of each of elements 710 and 712. Similarly, the gap separating elements 712 and 714 may be set to be less than the width of each of elements 712 and 714. The size of gap 720 and the width of the segments 710-714 of antenna elements 700 may be adjusted to control the capacitive loading, thereby controlling the desired resonant frequency. In this implementation, each of antenna elements 700 may be wound into a helical structure with a constant pitch angle on cylindrical structure 310.

Figure 8:
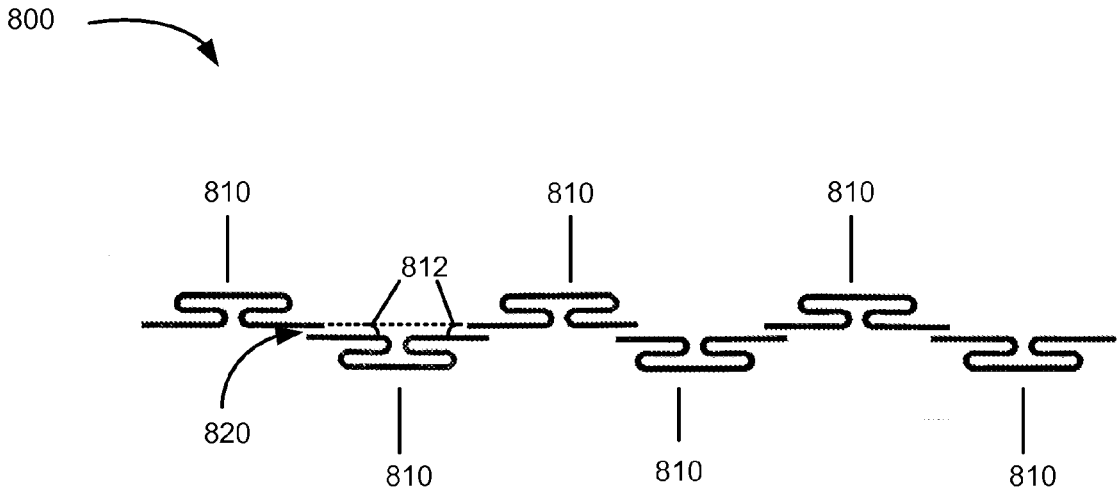
FIG. 8 illustrates an exemplary reactively loaded printed conducting strip antenna element.

FIG. 8 illustrates another implementation of a printed antenna element 800. Referring to FIG. 8, antenna element 800 includes alternately opposing/inverted segments 810 that have a mushroom-like shape. Each segment 810 may be separated from adjacent segments 810 by a gap, labeled as reference number 820 in FIG. 8. In this implementation, antenna element 800 has a distributed reactive loading. That is, antenna element 800 has simultaneous inductive and capacitive loading. In this implementation, a number of antenna elements 800 (e.g., four or more) may be wound into a helical structure with a constant pitch angle on cylindrical structure 310. For example, pitch angles 812 between adjacent segments 810 of antenna element 800 are the same for each of the segments 810. The distributed reactive loading enables QHA antenna 270 to have reduced height as compared to conventional QHAs.

Figure 9:
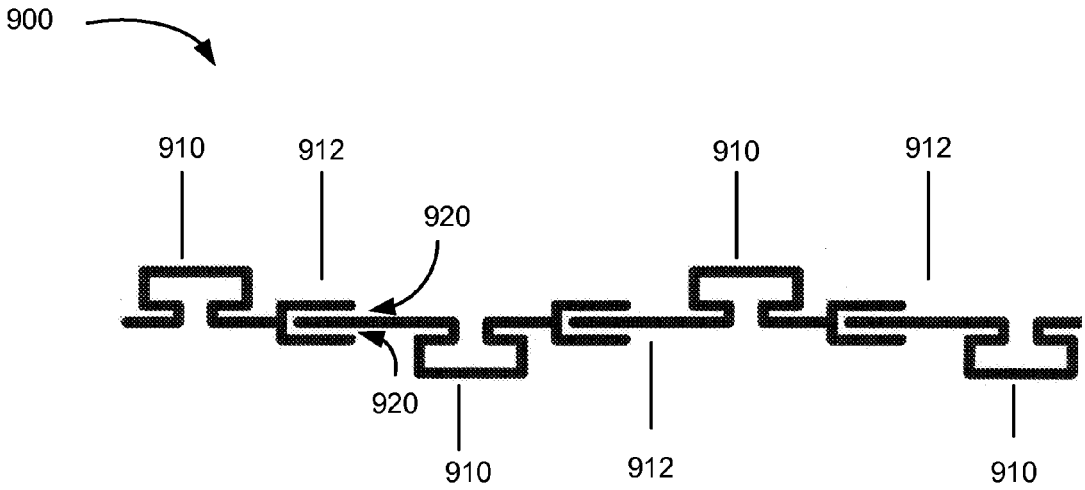
FIG. 9 illustrates an exemplary printed conducting strip antenna element having a constant pitch angle.

FIG. 9 illustrates still another implementation of a printed circuit element that may be used in antenna 270. Referring to FIG. 9, antenna element 900 may include a number of segments 910 and 912. Each of the segments 910 and 912 may be oriented with the same pitch angle with respect to an adjacent segment. In this implementation, each segment 900 may be connected to a portion of segment 912. In addition, portions of segments 912 may be separated from one another by gaps, labeled as numeral 920 in FIG. 9. In this manner, antenna element 900 has a distributed reactive loading (i.e., simultaneous inductive and capacitive loading). In addition, a number of antenna elements 900 (e.g., four or more) may be wound into a helical structure with a constant pitch angle on cylindrical structure 310. The distributed reactive loading enables QHA antenna 270 to have reduced height as compared to conventional QHAs.

Figure 10:
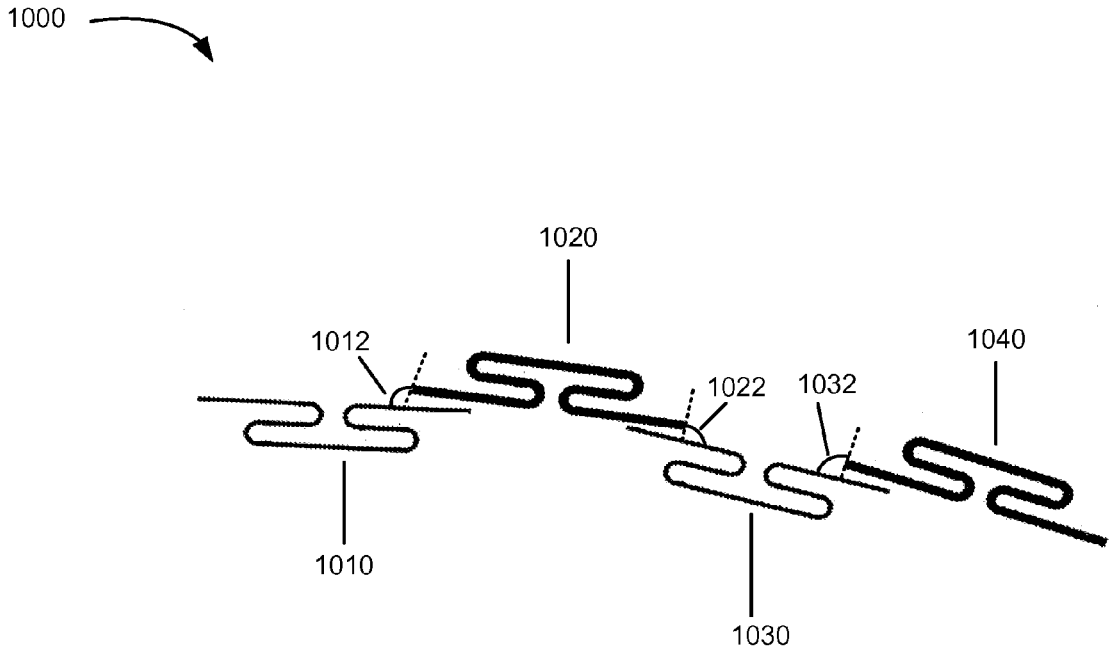
FIG. 10 illustrates an exemplary inductively loaded printed conducting strip antenna element with a discretely variable pitch angle.

FIG. 10 illustrates still another implementation of a printed circuit element that may be used in antenna 270. Referring to FIG. 10, antenna element 1000 may include a number of alternately opposing/inverted segments 1010-1040. Each of segments 1010-1040 may be oriented with a different pitch angle with respect to another segment. For example, segment 1010 may be oriented to segment 1020 with a first angle, labeled 1012, and segment 1020 may be oriented with respect to segment 1030 with a second angle, labeled 1022, that is different from the first angle. Further, segment 1030 may be oriented with respect to segment 1040 with a third angle, labeled 1032, that is different from the first and second angles, as illustrated in FIG. 10. In addition, as illustrated, each of segments 1010-1040 may include gaps between adjacent segments. In this implementation, antenna element 1000 has a distributed reactive loading (i.e., simultaneous inductive and capacitive loading). In addition, a number of antenna elements 1000 (e.g., four or more) may be wound into a helical structure with a discretely variable pitch angle on cylindrical structure 310. The distributed reactive loading enables QHA antenna 270 to have reduced height as compared to conventional QHAs.

Figure 11:
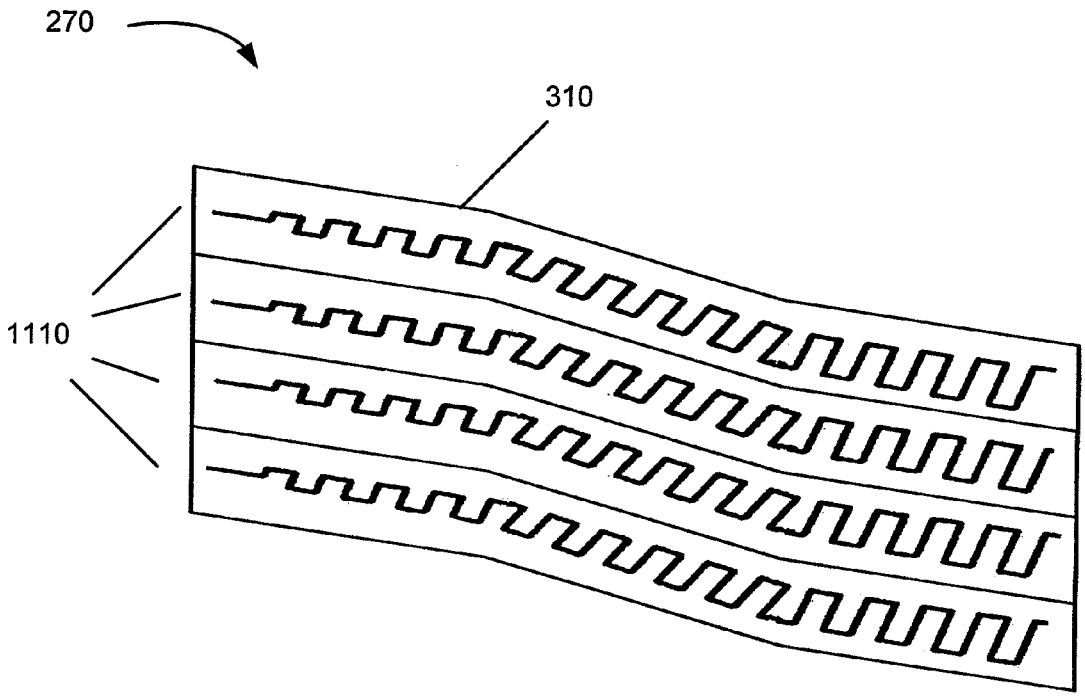
FIG. 11 illustrates exemplary inductively loaded printed conducting strip antenna elements with a discretely variable pitch angle.

FIG. 11 illustrates another implementation of printed circuit elements that may be used in antenna 270. Referring to FIG. 11, antenna 270 may include a number of antenna elements 1110 shown unfurled on the surface of cylindrical structure 310. Each of printed circuit elements 1110 may include a square wave-like pattern in which the height of the square waves varies over the length of structure 310. For example, the height of the square wave like pattern may be shorter on the left side of the structure 310 illustrated in FIG. 11 than on the right side of structure 310. The heights may also rise in a continuous or variable manner over the length of structure 310. Antenna elements 1110 may be wound into a helical structure with a discretely variable pitch angle on cylindrical structure 310. That is, the pitch angle associated with the square wave-like pattern of antenna elements 1110 may vary over the length of structure 310, as illustrated in FIG. 11. For example, the angle of one square wave with respect to an adjacent square wave of an antenna element 1110 may be different than the angles associated with other adjacent square waves located in other portions of the antenna element 1110. In this implementation, antenna 270 has a distributed inductive loading with a discretely variable pitch angle. The distributed inductive loading enables QHA antenna 270 to have reduced height as compared to conventional QHAs.

In the implementations described above, antenna 270 may be a QHA with a number of conducting strip antenna elements. The QHA may operate in a normal mode to provide near omni-directional coverage. In this normal mode of operation, the QHA 270 may be of a fractional turn (e.g., 0.75 turn) so as to avoid formation of nulls in the radiation pattern in elevation. In addition, the diameter to height ratio of the cylindrical structure 310 controls the radiation pattern along the elevation. Therefore reduction in height results in simultaneous reduction in the diameter of the antenna structure. The electrical length of the diameter in relation to the height may also determine the quality of circular polarization (of the desired sense with low cross polarization) along the elevation.

CONCLUSION

Systems and methods described herein provide for reduced size QHAs. This may allow the size of the mobile terminal incorporating the QHA to be reduced.

The foregoing description of preferred embodiments of the invention provides illustration and description, but is not intended to be exhaustive or to limit the invention to the precise form disclosed. Modifications and variations are possible in light of the above teachings or may be acquired from practice of the invention.

For example, implementations consistent with the invention have been described above with respect to use of a mobile terminal that may be used in a hybrid network that utilizes a terrestrial network and a satellite/space-based network. It should be understood, however, that implementations consistent with the invention may be used in other types of networks and are not limited to any particular type of network. Implementations have also been described as being used in a mobile terminal 110 for placing and receiving telephone calls. In other instances, other types of signals, such as global positioning system (GPS) signals, video signals, multi-media signals, or any other type of signals may be received and/or transmitted using QHAs described above.

It will also be apparent to one of ordinary skill in the art that aspects of the invention have been described above with reference to various shaped and sized conductive strip antenna elements. Details associated with forming these elements has not been described in order to not unduly obscure the thrust of the invention—it being understood that one of ordinary skill in the art would be able to fabricate such elements based on the description herein. In addition, it should be understood that conductive strip elements having shapes and/or sizes other than those described above may be used in other implementations.

For example, lumped element type antenna elements may be used in some implementations, as opposed to distributed antenna elements. In this case, the lumped type antenna element may include one or more printed circuit elements located on structure 310 that are formed in a more concentrated manner with respect to portions of structure 310, as opposed to being uniformly distributed over the length of structure 310.

Figure 12:
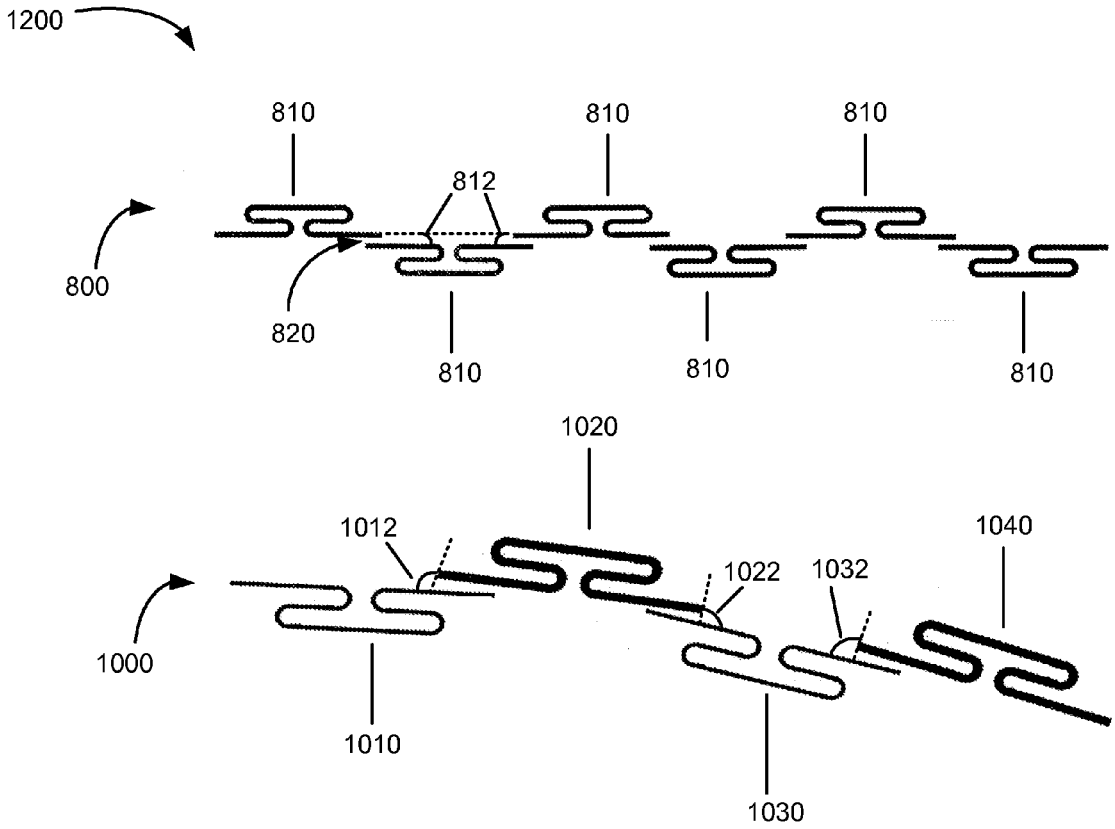
FIG. 12 illustrates an exemplary conducting strip antenna element in which a portion of the antenna element has a constant pitch angle and another portion of the antenna element has a discretely variable pitch angle.

In addition, in some implementations, combinations of constant pitch angle and discretely variable pitch angle antenna elements may be used. For example, one conductive strip antenna element that forms part of a QHA may have a number of segments with a constant pitch angle and another conductive strip element on the same QHA may have a number of segments with a discretely variable pitch angle, as illustrated in FIG. 12. For example, QHA 1200 illustrated in FIG. 12 may include one conductive strip element 800 having a number of segments 810 with a constant pitch angle 812 between adjacent segments 810, and another conductive strip element 1000 with segments 1010-1040 having different, discretely variable pitch angles 1012, 1022 and 1032.

No element, act, or instruction used in the description of the present application should be construed as critical or essential to the invention unless explicitly described as such. Also, as used herein, the article "a" is intended to include one or more items. Where only one item is intended, the term "one" or similar language is used. Further, the phrase "based on" is intended to mean "based, at least in part, on" unless explicitly stated otherwise.

What is claimed is:

1. A quadrifilar helix antenna for transmission and reception of wireless signals by hand-held terminals, the antenna comprising a plurality of antenna elements, wherein at least a first one of the plurality of antenna elements includes a first group of segments and a second group of segments, and wherein each of the segments in the first group and each of the segments in the second group includes first and second linear portions located on respective ends of the segment and a non-linear central portion connected to the first and second linear portions, and wherein the second group of segments is inverted with respect to the first group of segments; and a feed structure coupled to the antenna elements.

2. The quadrifilar helix antenna of claim 1, wherein at least some of the plurality of antenna elements are capacitively loaded and inductively loaded when the antenna is transmitting or receiving wireless signals.

3. The quadrifilar helix antenna of claim 1, wherein the first antenna element includes a plurality of segments each comprising at least one of the first or second group of segments and wherein a pitch angle associated with the plurality of segments varies over a length of the first antenna element.

4. The quadrifilar helix antenna of claim 1, wherein the first antenna element includes a plurality of segments each comprising at least one of the first or second group of segments and wherein a pitch angle associated with the plurality of segments is constant over a length of the first antenna element.

5. The quadrifilar helix antenna of claim 1, wherein a height of the antenna ranges from approximately 2.75 inches to approximately 3.0 inches.

6. The quadrifilar helix antenna of claim 5, wherein a diameter of the antenna ranges from approximately 0.3 inches to approximately 0.35 inches.

7. The quadrifilar helix antenna of claim 1, wherein the linear portion of one of the first group of segments overlaps with the linear portion of one of the second group of segments and the non-linear central portion of each of the segments has a curved, mushroom-like cross-sectional shape.

8. The quadrifilar helix antenna of claim 1, wherein the linear portion of one of the first group of segments overlaps with the linear portion of one of the second group of segments and the non-linear central portion of each of the segments has a rectangular cross-sectional shape.

9. The quadrifilar helix antenna of claim 1, wherein the first group of segments are separated from corresponding ones of the second group of segments by a gap.

10. The quadrifilar helix antenna of claim 1, further comprising:

a cylindrical structure, wherein the plurality of antenna elements comprises four antenna elements wound onto the cylindrical structure.

11. A quadrifilar helix antenna for transmission and reception of wireless signals by hand-held terminals, the antenna comprising a plurality of capacitively loaded antenna elements; and a feed structure coupled to the antenna elements, wherein at least a first one of the plurality of antenna elements includes a plurality of segments and wherein a pitch angle associated with the plurality of segments varies over a length of the first antenna element, and wherein at least a second one of the plurality of antenna elements includes a plurality of segments and wherein a pitch angle associated with the plurality of segments is constant over a length of the second antenna element.

* * * * *